US005860769A

United States Patent [19]

Seligman

[11] Patent Number: 5,860,769

[45] Date of Patent: Jan. 19, 1999

[54] COMBINATION BUOYANCY COMPENSATOR AND SUPPORT FOR A DIVER'S BACKPACK WITH A SWIVEL BUCKLE AND TRIANGULAR HOLDER

[75] Inventor: Scott P. Seligman, Carlsbad, Calif.

[73] Assignee: SeaQuest, Inc., Carlsbad, Calif.

[21] Appl. No.: 707,525

[22] Filed: Sep. 4, 1996

[51] Int. Cl.[6] ..... A45F 3/04; B63C 11/02

[52] U.S. Cl. ..... 405/186; 224/264; 224/579; 224/627; 224/640

[58] Field of Search ..... 24/616, 633, 634, 24/637, 614, 615; 405/186; 224/578–580, 627, 639, 258, 264

[56] References Cited

U.S. PATENT DOCUMENTS

| | | | |
|---|---|---|---|
| D. 329,210 | 9/1992 | Cullmann | D11/216 |
| D. 349,871 | 8/1994 | Murai | D11/216 |
| D. 352,680 | 11/1994 | Matoba | D11/216 |
| 4,540,218 | 9/1985 | Thomas | 24/633 X |
| 4,778,307 | 10/1988 | Faulconer | 405/186 X |
| 4,793,032 | 12/1988 | Crowle | 24/634 X |
| 5,361,953 | 11/1994 | Nichols | 224/627 X |
| 5,451,121 | 9/1995 | Seligman . | |
| 5,471,716 | 12/1995 | Takahashi | 24/615 |
| 5,641,247 | 6/1997 | Seligman | 405/186 |

*Primary Examiner*—Tamara L. Graysay
*Assistant Examiner*—Tara L. Mayo
*Attorney, Agent, or Firm*—George F. Bethel; Patience K. Bethel

[57] ABSTRACT

A buoyancy compensator and support vest, harness or spider for supporting a diver's backpack, includes a pivoting fastener secured to the shoulder straps. A polyangular or triangular holder further distributes the weight of a load between the waist, back and shoulders of a user. A strap incorporating the pivoting fastener and/or the polyangular or triangular holder for use with a backpack or other back carrier or framework or support harness is also provided.

20 Claims, 8 Drawing Sheets

Fig. 16
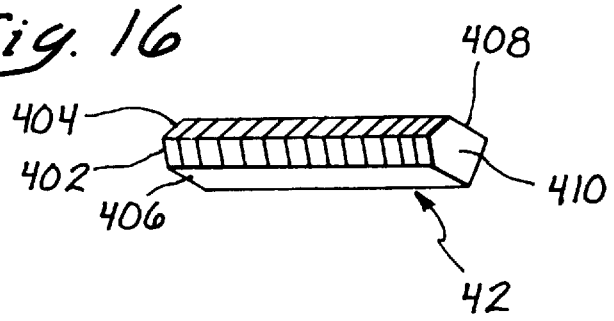
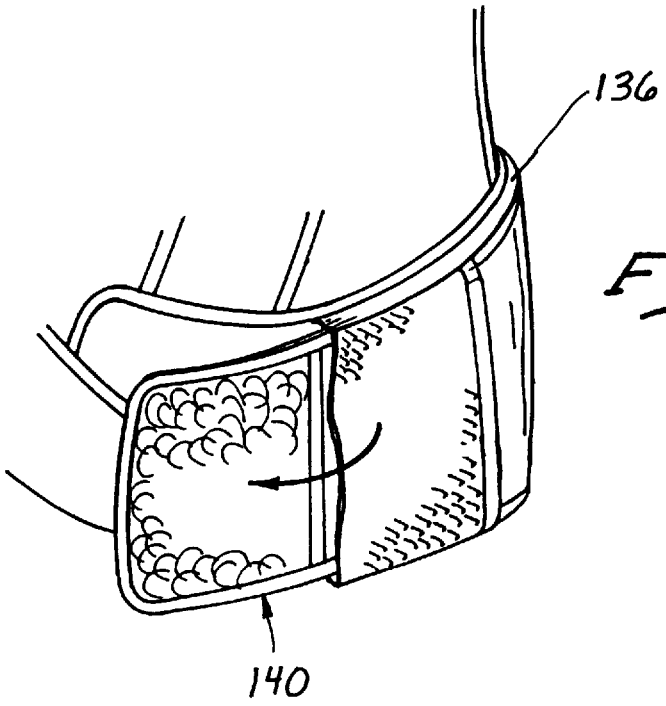
Fig. 17
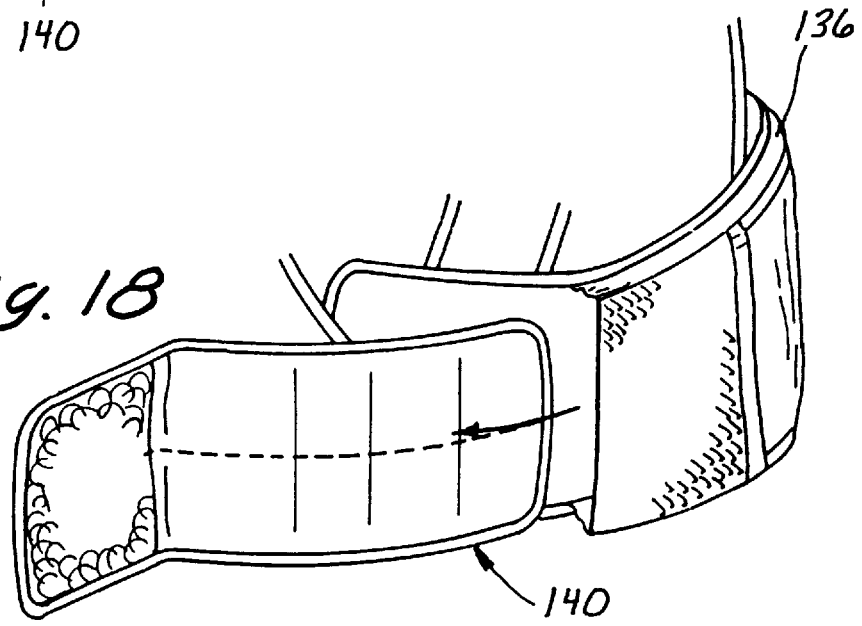
Fig. 18

COMBINATION BUOYANCY COMPENSATOR AND SUPPORT FOR A DIVER'S BACKPACK WITH A SWIVEL BUCKLE AND TRIANGULAR HOLDER

FIELD OF THE INVENTION

This invention relates to the field of buoyancy compensators, backpacks, harnesses, vests, frameworks and other carrier means for supporting a weight on a users back and particularly to a combination buoyancy compensator and support, such as a vest, spider or harness, for a diver's backpack, and to other back supports, all having novel strap means which improve comfort and facilitate the use thereof.

DESCRIPTION OF THE PRIOR ART

Underwater diving preferentially requires the use of a buoyancy compensator having an inflatable bladder to provide for buoyancy trim or compensation to a diver.

Buoyancy compensators are inflated by oral power or compressed gas inflation means. During inflation, the diver is provided with increased buoyancy at greater depths to overcome the fact that a diver's buoyancy decreases as he dives deeper. This is because with greater pressure, a loss takes place regarding the lifting characteristics of the diver's buoyancy, primarily due to compression of his exposure suit and associated diving equipment.

Conversely, as the diver ascends or approaches the surface his buoyancy increases as the compression of his exposure suit and other equipment recovers. As inherent buoyancy is regained, air must be released from the buoyancy compensator to return the system to neutral buoyancy.

Thus, by increasing or decreasing the buoyancy provided by the buoyancy compensator, a diver can adjust his buoyancy to a neutral state. This is provided by either adding air to the buoyancy compensator or releasing it.

In recent years, buoyancy compensators have been combined with a support such as a harness or vest configuration commonly called a spider with means to hold a diver's backpack that supports a container or tank of pressurized breathing gas on a diver's back. The vest or harness configuration often includes shoulder straps and a front closing waist or belt fastener for ease in putting on and securing the buoyancy compensator.

During the process of inflation and deflation, the buoyancy compensator's inflatable bladder or inner chamber changes dimensions substantially compared with its uninflated state. When inflated, the buoyancy compensator changes from its original flat configuration and becomes more spherical in shape. This change in dimension causes tightening around the diver's waist since the bladder within the buoyancy compensator must expand against the diver's body and there is no opportunity for the interior dimensions to be adjusted. This tightening around the diver's waist creates a pulling tension against the waist fastener. If only a loops and hooks fastener, i.e. VELCRO™, is used, this can in some instance cause the waistband to open.

Similarly, when the buoyancy compensator is deflated, pressure against the body is decreased. This causes a loosening of the pressure around the body and waist with the possible shifting of the load provided by the tank.

Changes in buoyancy also result in increases and decreases in the load exerted by the pressurized tank or cylinder held on the backpack. Some buoyancy compensator combinations include adjustable shoulder straps attached to the waistband or belt fastener. When the waistband or belt is tightened, there is a corresponding tightening of the shoulder straps. Thus, changes in buoyancy can result in discomfort to the diver.

Also, an increase in the load of the tank pulls the shoulder straps upwardly putting a corresponding upward pull on the waistband. At the same time, the tank weight pulls the backpack downwardly exerting a backward force on the waistband. In addition, the use of weights for buoyancy adjustment which are carried on the waistband causes an additional downward force.

Other types of back supported carriers or backpack means such as back supported frameworks or harnesses such as those for camping, child carriers, and student book backpacks result in a tightening of the shoulder straps when the weight of the load that is carried is increased. This is partially alleviated by padding of the shoulder portions of the straps, but this does not remove the tendency of the straps to cut into the chest in the area of the shoulder.

It is an object of this invention to provide a support such as a vest or support harness or spider for support of a diverts backpack having novel pivoting shoulder strap securement means.

It is an object of this invention to provide a combination buoyancy compensator and support, such as a vest or support harness or spider for a diver's backpack having novel pivoting shoulder strap securement means.

It is a further object of the invention to provide a triloading weight distribution suspension means for a combination buoyancy compensator and support, such as a vest, spider or support harness for a diver's backpack that minimizes the effects on the body and waist of a diver caused by the inflation and deflation of the bladder of the buoyancy compensator.

It is another object of the invention to provide a camping, child backpack carrier, book backpack or other back carried harness or framework for support of the weight of a load and having novel pivoting or swiveling shoulder strap means.

It is another object of the invention to provide a camping, child backpack carrier, book backpack or other back carried harness or framework for support of the weight of a load having distributed loading suspension means on the shoulder straps.

SUMMARY OF THE INVENTION

The novel combination buoyancy compensator and support, such as a vest, spider or harness, for a diver's backpack of the invention provides a distributed loading system for the buoyancy compensator combination.

Novel adjustable strap means on the support vest, spider or harness include a chest member or shoulder strap attached to one part of a swivel buckle, with a strap attached to the other interlocking part. The opposite end of the strap is fastened to a waistband or belt.

In another embodiment, the chest member or shoulder strap is fastened to one side of a polyangular or triangular holder or clasp. Two other sides of the polyangular or triangular holder or clasp are fastened to the waistband or belt and to the back of the vest, spider or support harness. This three way attachment acts to distribute the weight of a load between the shoulders, back and waist.

The novel chest or shoulder strap support with a swivel buckle minimizes tightening when the shoulder straps are under a load. When the weight of a load is increased the swivel buckle pivots or turns to distribute some of the upward force to the back. When the polyangular or triangular holder or clasp is also included, it orients and distributes the weight of a load between the shoulders, back and waist.

The combination of the swivel buckle and the polyangular or triangular holder or clasp serves to improve the convenience and comfort of a diver by supporting the backpack and buoyancy compensator on a vest, spider, or harness so that the buoyancy compensator is maintained close to the body of a diver for improved hydrodynamics by holding the buoyancy compensator securely attached to the diver. This combination improves the capability of a diver to function as well as to increase comfort.

The swivel buckle and the polyangular or triangular holder or clasp provide similar advantages to shoulder and chest straps attached to a camping backpack, to a child backpack carrier, to a book backpack or other harness or framework for carrying a weight on the back of a user.

As used herein and in the appended claims, the term "support" is intended to include a vest, a spider, a harness or other back support for supporting the load of a weight on a user's back.

The term "combination buoyancy compensator and support" is intended to include a combination of a buoyancy compensator with a vest, a spider, a harness or other back support.

The invention does not lie in the swivel buckle or the polyangular or triangular clasp which are known but rather in their application to shoulder straps or chest members, vests, harnesses and other back supports to prevent slippage of shoulder straps and the like in the case of the swivel buckle and to distribute the load or weight in the case of the polyangular or triangular clasp.

BRIEF DESCRIPTION OF THE DRAWINGS

The invention will be more clearly understood by referring to the description below and the accompanying drawings in which:

FIG. 16 shows a perspective view of the cross bar of the fastener of FIGS. 4, 5, and 6.

FIG. 17 shows a detail of the removable weights shown in the combination buoyancy compensator and support and backpack unit of FIG. 7 with a fastening flap of the envelope for containing the weights in the open position.

FIG. 18 shows a detail of the removable weights shown in the combination buoyancy compensator and support and backpack unit shown in FIG. 7 with the envelope for containing the weights removed from the pocket.

DETAILED DESCRIPTION

Figure 1:
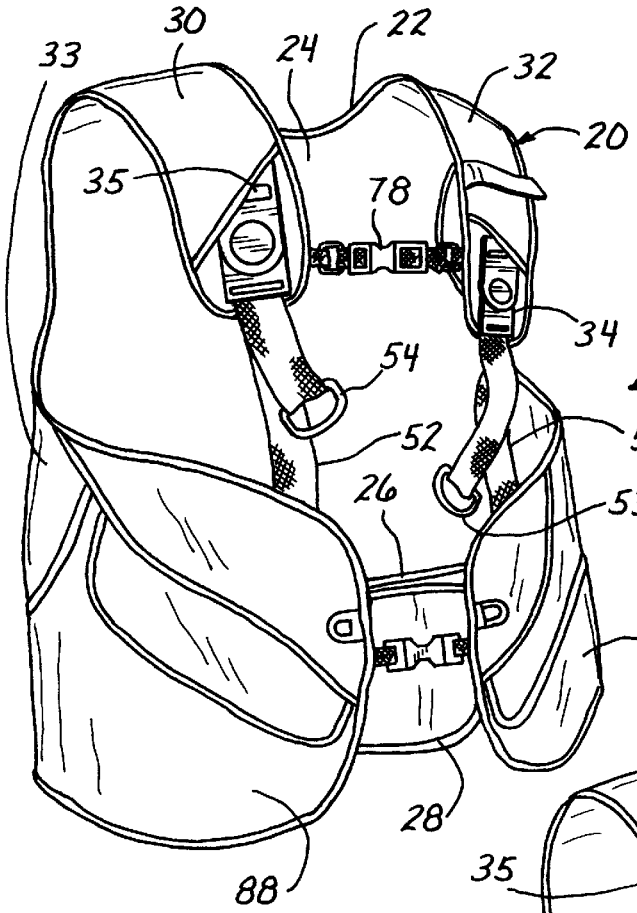
FIG. 1 shows a perspective view of a combination buoyancy compensator and support and backpack unit of the invention.

Referring now to FIG. 1 there can be seen a combination buoyancy compensator and support vest, spider or harness or other support for a backpack 20 of the invention. The combination unit includes support such as a spider, harness or vest or other back support 22 including a back portion 24. The lower area of the back portion 24 extends forward into waist portions or waistbands 26 and 28. The waist portions or waistbands 26 and 28 have interlocking hooks and brushed fabric or pile areas, i.e. VELCRO™, for front overlapping securement.

Curved shoulder or chest portions 30 and 32 extend from and are attached to back portion 24. Padding or other cushioning is commonly provided to the shoulder or chest portions 30 and 32.

Independent shoulder harnesses can be utilized without a vest, bladder or buoyancy compensator of this invention, or with independent, modular single or multiple bladders.

The buoyancy compensator 33 is suspended from the vest, spider or harness 22 by attachment as by stitching, gluing or riveting at the shoulders and neckline areas and loosely tethered in plural locations, not shown, at the bottom back and sides of the vest, spider or harness 22.

Here again, the buoyancy compensator portion can be in the form of an independent buoyancy compensator bladder or bladders.

A swivel or pivoting fastener or buckle 34 is secured to the shoulder or chest portions 30 and 32 by means of a short strap 35. The buckle or fastener 34 includes two interlocking parts 36 and 38.

Figure 4:
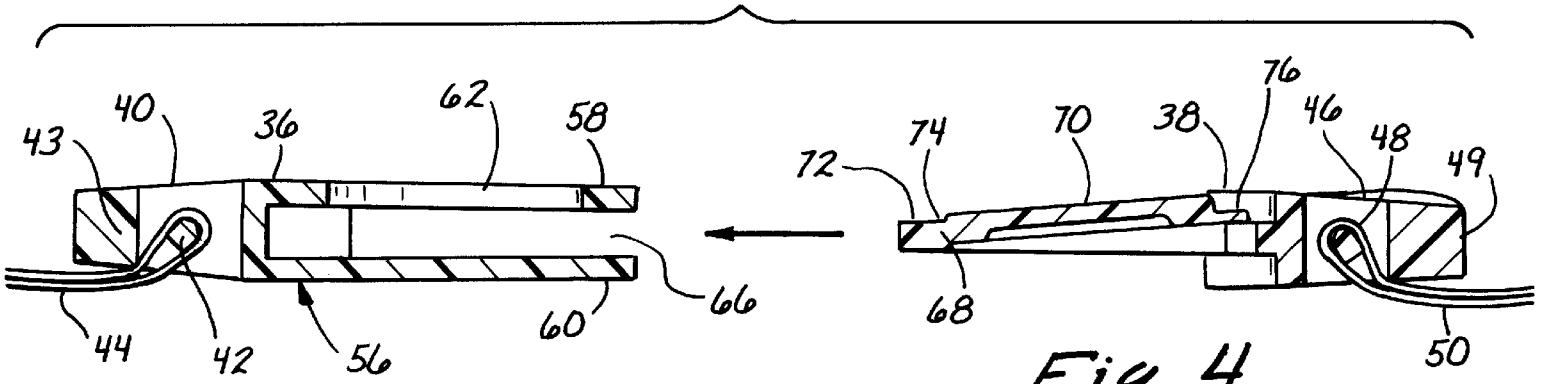
FIG. 4 shows a cross section of the swivel buckle of FIG. 3 with the two parts in the separated condition.
Figure 5:
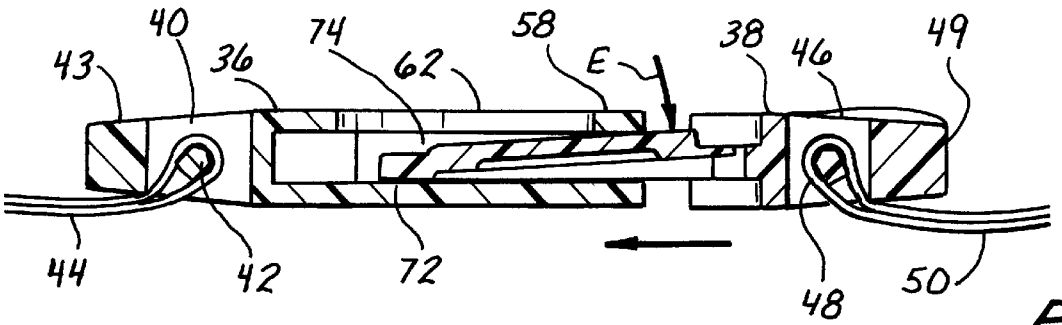
FIG. 5 shows a cross section of the swivel buckle of FIG. 3 with the two parts partially united, and ready to be snapped into position.
Figure 6:
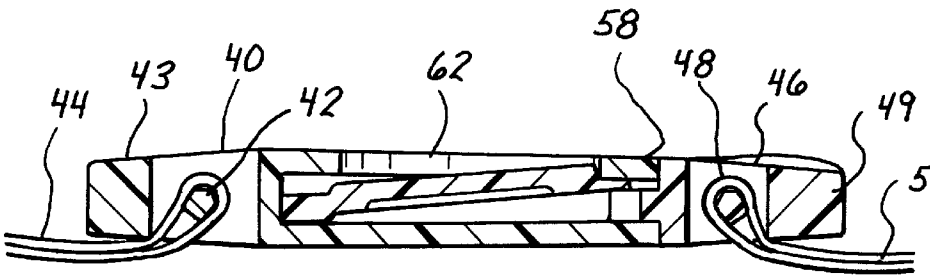
FIG. 6 shows a cross section of the swivel buckle of FIG. 3 taken along the lines 6—6 of FIG. 3, with the two parts completely engaged.

As shown in FIGS. 4–6, the female buckle part 36 includes a slot 40 having a crossbar 42 and a cross member 43 for securement to a strap or fabric loop 44 which in turn is secured to the shoulder or chest portions or bands 30 and 32. Preferably, the crossbar 42 and the cross member 43 have at least one gripping surface for securing the strap or fabric loop 44 against slippage during use. As shown in FIG. 16, the crossbar 42 has a roughened or toothed gripping surface 402 and 410 on one portion of its length and a smooth surface 406, 408 and 410 along other portions of its length. Contact with the gripping surfaces 402 and 410 holds the strap in place whereas contact with the smooth surfaces 406, 408, and 410 permit sliding of the strap.

Similarly, the male buckle part 38 includes a slot 46 having a crossbar 48 and a cross member 49 for securement to chest straps 50 or 52 which are secured to waistband portions 26 or 28 respectively. Preferably, the crossbar 48 and the cross member 49 have at least one gripping surface for securing the strap or fabric loop 50 against slippage during use.

Length adjustment of the chest straps 50 or 52 can be made by pulling on rings 53 and 54 which are secured to the free ends respectively. Pulling on the rings or straps shortens the straps 50 and 52 which are held in place by the at least one gripping surface on the crossbar 42 and the cross member 43 and/or by the at least one gripping surface on the crossbar 48 and the cross member 49. Upwardly lifting the end of the buckle containing the crossbar 48 and the cross member 49 or the crossbar 42 and the cross member 43 releases the strap from the gripping surface to permit lengthening. Here again, the chest straps 50 or 52 can be shoulder straps and a waist strap supporting the backpack and/or buoyancy compensator.

The female buckle part 36 further includes an elongated member 56 made up of two generally parallel, thin, spaced apart members 58 and 60. Top member 58 has a circular opening 62 therein. The spaced apart members 58 and 60 form a slot 66 which is sized to receive the male buckle part 38.

The male buckle part 38 includes a flat elongated member 68 having a circular spring-loaded member 70 attached at its leading edge 72. The circular spring member 70 has a circular shoulder 74 surrounding the member 70. Opposite the leading edge 72, the shoulder 74 extends into a projection or tab 76.

The circular spring-loaded member 70 is received within the circular opening 62 of top member 58 of female buckle part 36. As shown in FIG. 5, insertion of the male buckle part 38 into the slot 66 formed between spaced apart members 58 and 60 initially causes spring member 70 to be compressed in the direction indicated at arrow E.

Further insertion frees the compression and allows the spring member 70 to spring or snap into circular opening 62 whereby shoulder 74 of circular spring-loaded member 70 engages and is held within circular opening 62. At the same time, the tab member 76 presses against the underside of top member 58. The engaged position is shown in FIG. 6.

Figure 3:
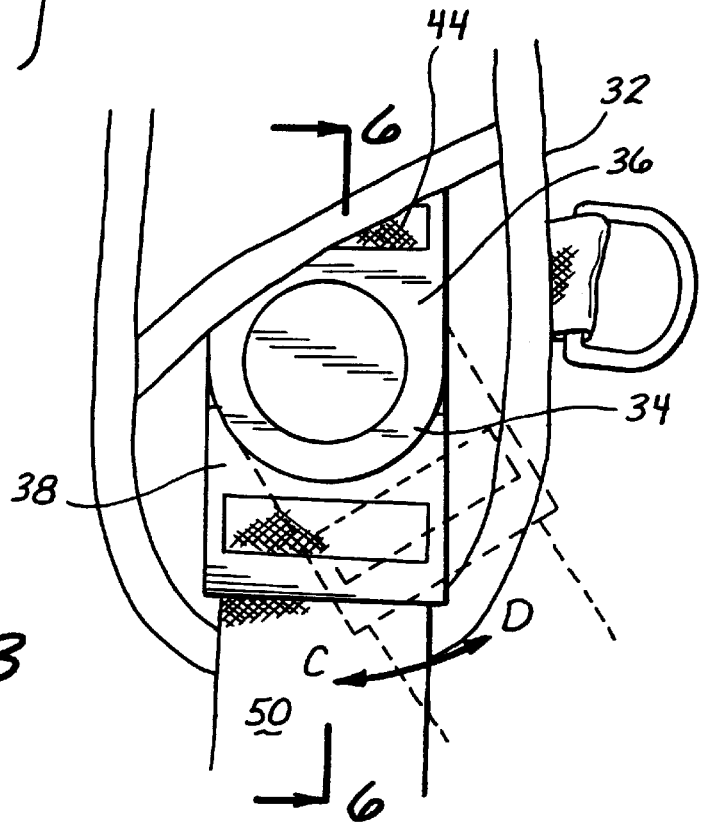
FIG. 3 shows the swivel buckle of FIG. 2 in the attached condition with the swivel effect indicated by a dotted overlay.

When the interlocking buckle members 36 and 38 are engaged, they are capable of rotating, pivoting or swiveling relative to each other. The rotation or swiveling in the manner illustrated by arrows C–D in FIG. 3, provides a particular advantage when the buoyancy compensator is inflated as shown in FIG. 1A.

Figure 1A:
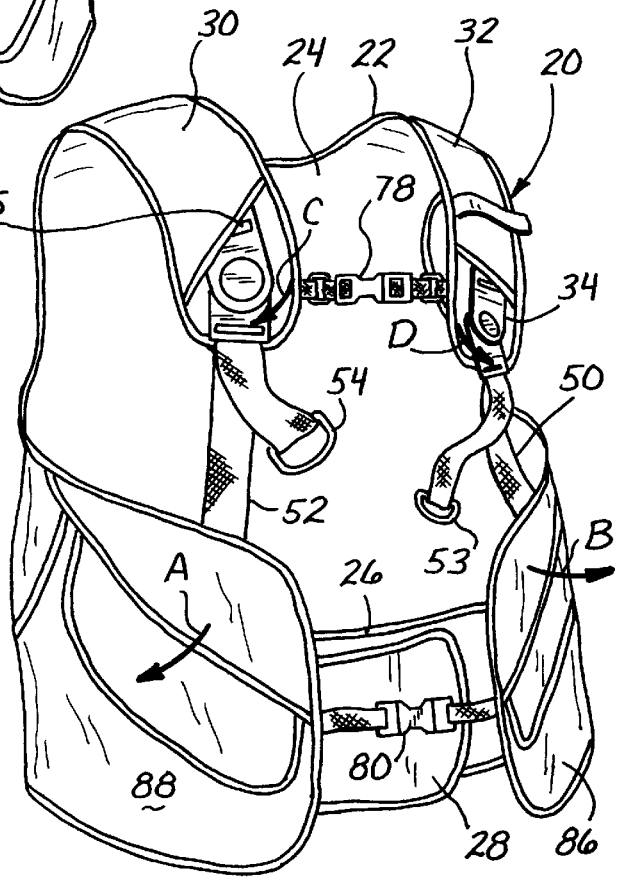
FIG. 1A shows a perspective view of the combination buoyancy compensator and support and backpack unit of FIG. 1 with the buoyancy compensator inflated.
Figure 2:
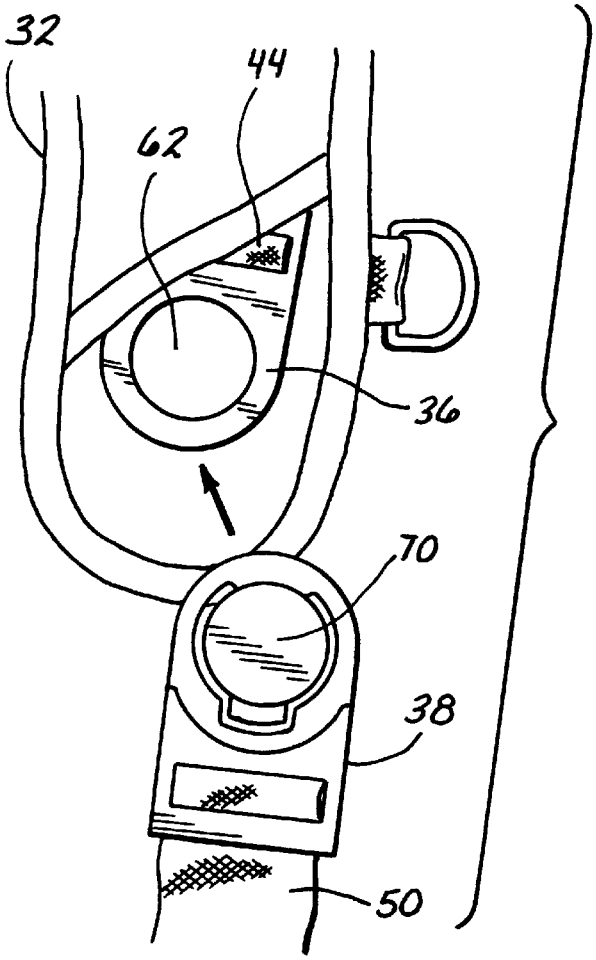
FIG. 2 shows an enlarged showing of the swivel buckle of the invention in the separated condition.

The forces indicated at arrow A and arrow B of FIG. 1A are directed downwardly and toward the back of the combination unit 20. In the inflated condition as shown in FIG. 1A, the swivel buckle 34 pivots toward the back as indicated at arrows C and D alleviating the pressure on the shoulders and chest of a user. Without the swivel buckle 34, inflation of the buoyancy compensator pulls the shoulders 30 and 32 backwardly.

To further secure the shoulder or chest portions 30 and 32 and to prevent slipping, a chest fastener or buckle 78 is preferably attached between the shoulder or chest portions 30 and 32.

Additional securement of the waistbands 26 and 28 is provided by buckle 80 which is attached to the waistbands 26 and 28 and is fastened after they are overlapped.

Figure 8:
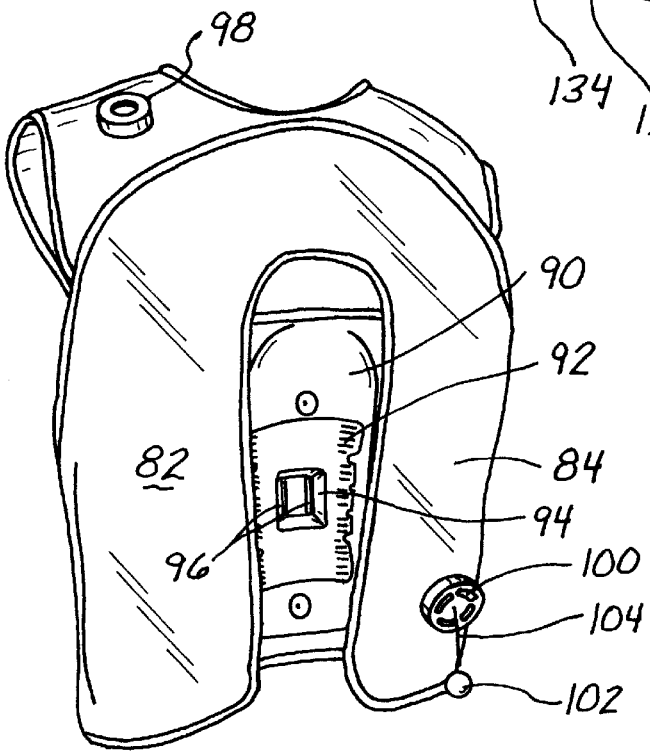
FIG. 8 show a rear elevation view of the combination buoyancy compensator and support and backpack unit of the invention.

The buoyancy compensator 33 shown in FIGS. 1 and 1A has a generally inverted U-shape formed by lobes 82 and 84 as shown in rear elevation of FIG. 8. The lobes 82 and 84 have portions 86 and 88 which extend forwardly around the waistband members 26 and 28. Other buoyancy compensator designs having different configurations and which do not include the forwardly extending members can also be used with the invention.

Also, modular single and multiple buoyancy compensators can be attached in any suitable manner as known in the art. This would include those buoyancy compensators that comprise all or a portion of a vest having the straps or harness or spider set forth herein.

The inverted U-shape of the buoyancy compensator 33 surrounds a breathing gas cylinder support means such as the hard diver's backpack 90 shown in FIG. 8.

The diver's backpack 90 is secured to the support such as the spider, harness or vest 22. Preferably, the top and the sides of the diver's backpack 90 are secured or attached as by stitching, riveting, bolting or other means to the spider, harness or vest 22 so that the space between the spider, harness or vest and the diver's backpack remains free.

Preferably, the diver's backpack 90 is formed of a hard plastic having a raised surface that is molded to the curved contour of a pressurized gas cylinder.

A centrally located traction pad 92 prevents slippage of the gas cylinder. Within the traction pad 92 is an aperture 94 having ribs 96 for insertion of a band or strap, not shown, to secure a tank or cylinder of pressurized breathing gas against the traction pad 92 to be held against the diver's backpack 90.

Inflation and deflation of the buoyancy compensator 33 takes place through an over pressure release valve and filling port disposed in an opening 98 in the shoulder portion. Emergency dumping of the air is provided by means of a valve 100 disposed within the rear of the buoyancy compensator 33. The valve 100 is opened by pulling on the handle 102 which pulls the attached cord 104 to open the valve 100.

Figure 7:
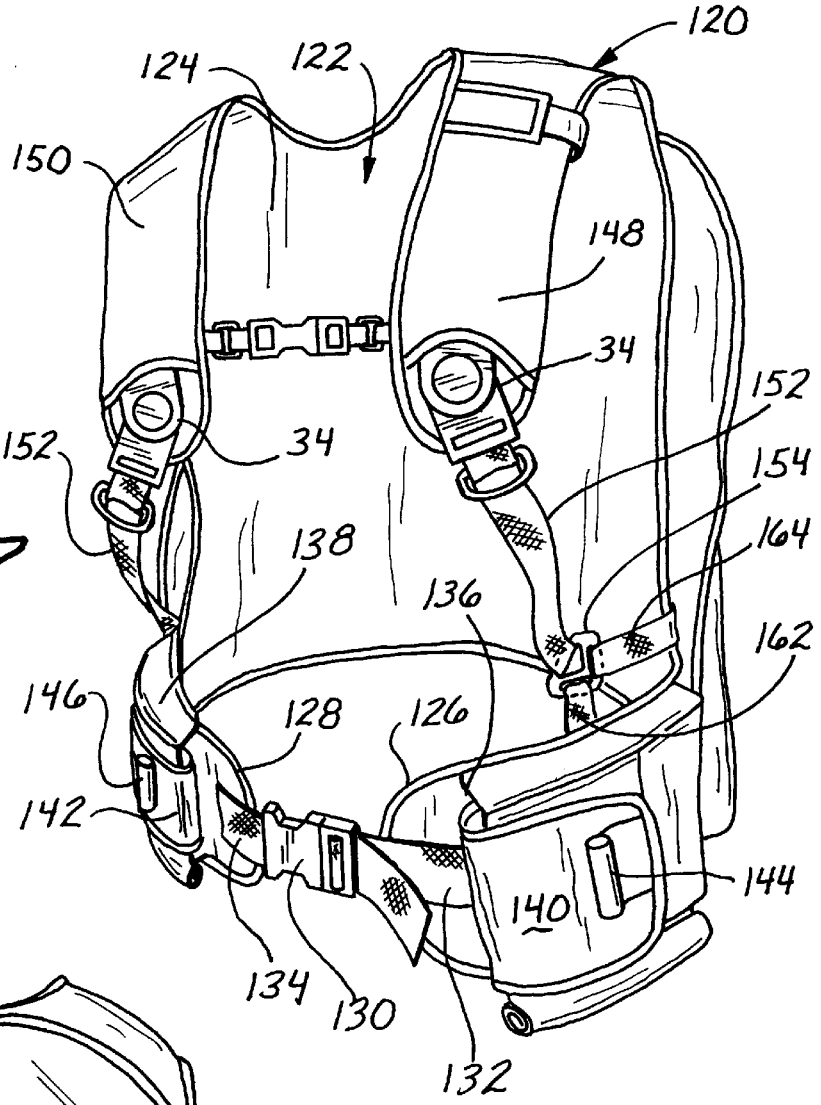
FIG. 7 shows a perspective view of another embodiment of the combination buoyancy compensator and support and backpack unit of the invention in the loaded condition to illustrate the operation of the swivel buckle and the triangular clasp.

Another embodiment of the invention is shown in FIG. 7 which shows a combination buoyancy compensator and support vest, harness or spider and backpack unit 120.

As in the embodiment of FIGS. 1 and 1A, the vest, harness or spider 122 includes a back portion 124 which extends forwardly into waistband portions 126 and 128 which can fasten by overlapping area of hooks and pile, i.e. VELCRO™. An attached buckle 130 and waist straps 132 and 134 provide additional securement of the waistband portions 126 and 128.

The waistband portions 126 and 128 have pockets 136 and 138 for holding removable weights contained in envelopes 140 and 142. The envelopes 140 and 142 containing the weights are removed by grasping on the handle 144 or 146 respectively and pulling forwardly as shown in FIGS. 17 and 18.

The weights in the envelopes 140 and 142 provide additional buoyancy adjustment. At the same time, the weights exert a heavy downward force at the front of the vest, spider or harness 122 which can lead to discomfort for a diver which is minimized by the invention.

Attached to and extending from the back portion 124 of the support vest, harness or spider 122 are curved shoulder or chest portions 148 and 150 which are provided with padding or other cushioning.

The shoulder portions 148 and 150 can be a vest, and attached independently to the backpack. Here again, modular buoyancy compensator members in singular or multiple form can be configured for attachment to the back, front, or around a user's waist and/or chest.

A swivel or pivoting fastener or buckle 34 as above described is secured at one end to the shoulder or chest portions 148 and 150 as shown in the embodiment of FIGS. 1 and 1A. The other end of the buckle 34 is secured to a chest strap 152 which is attached to a triangular clasp or holder 154.

Figure 10:
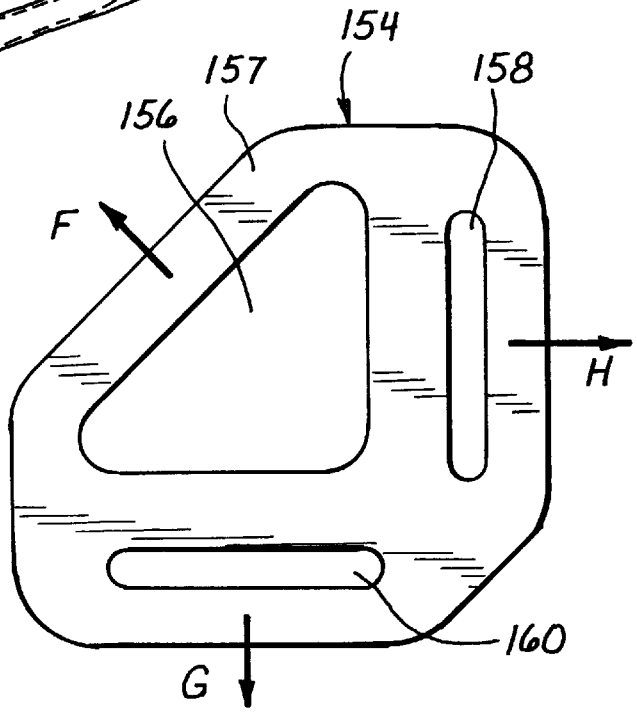
FIG. 10 shows the triangular clasp or holder with the straps removed.

The triangular clasp or holder 154 can be seen in FIG. 10. It has a generally triangular configuration with a triangular opening 156 having a side 157 on one side and two slots 158 and 160 parallel to the other two sides. Preferably, the side 157 of the triangular opening 156 forms the base of the triangular shape of the clasp or holder 154.

Figure 9:
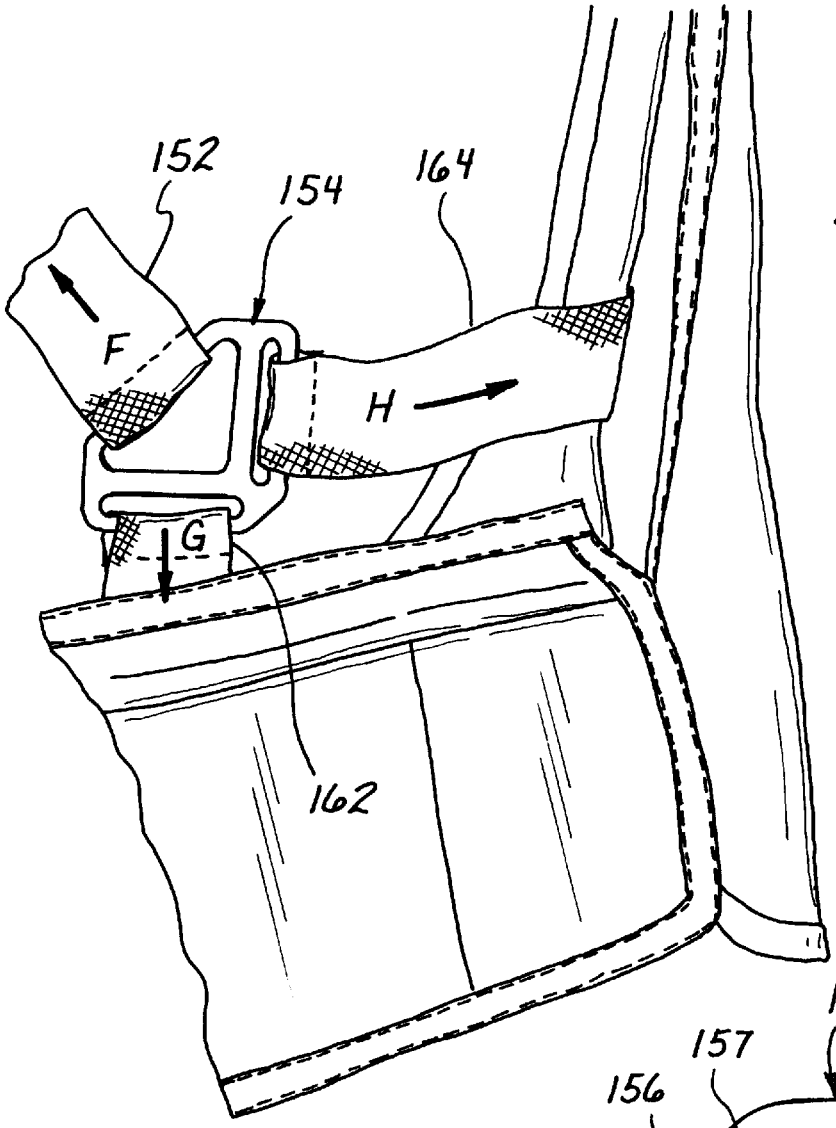
FIG. 9 shows an enlarged detail of the triangular clasp of FIG. 7 with the straps attached and undergoing various loads thereon.

As shown in FIGS. 7 and 9, the side 157 forming the base of the triangular clasp 154 is attached to one end of each chest strap 152 which is secured to the swivel buckle 34. One slot 158 is secured to a strap 162 which is anchored to the waistband portions 126 or 128. The other slot 160 is secured to a strap 164 which is anchored to the back of the vest, harness or spider 122.

In this manner, by attaching the strap 152 to the base side 157 of the triangular clasp 154, the strap 152 can effectively curve around the arm and shoulder of a user. At the same time, the slot 160 which forms a side or leg of the triangular clasp 154 can be attached to the strap 162 so that strap 162 is generally perpendicular to the waistband portion 126 or 128. The slot 158 forming a side or leg to the triangular clasp 154 can be attached to the rear strap 164 so that strap 164 extends generally horizontally from the clasp 154 to the back of the vest, harness or spider 122.

Figure 13:
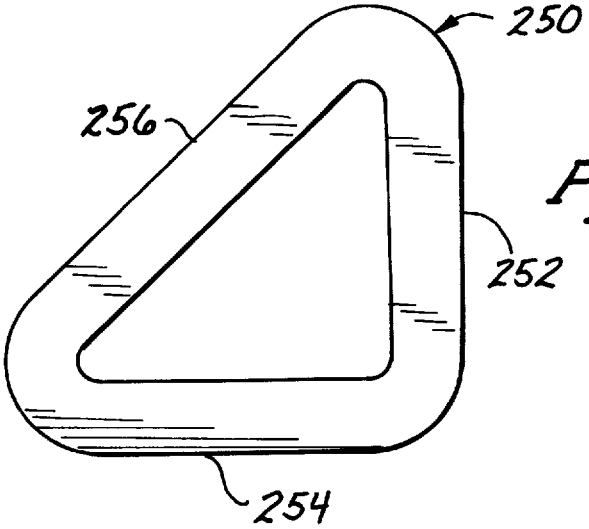
FIGS. 13, 14 and 15 show other embodiments of the polyangular clasp.

Another embodiment of the triangular clasp is shown in FIG. 13. As shown, the triangular clasp 250 has three sides, 252, 254, and 256 for holding straps 164, 162, and 152 respectively in the same manner shown in FIG. 9.

While the triangular clasp 154 is shown as a generally right triangle with the hypotenuse attached to the straps 152, other triangular or polyangular shapes can be used as long as there are at least three anchoring sides for attachment of the straps 152, 162 and 164.

Figure 14:
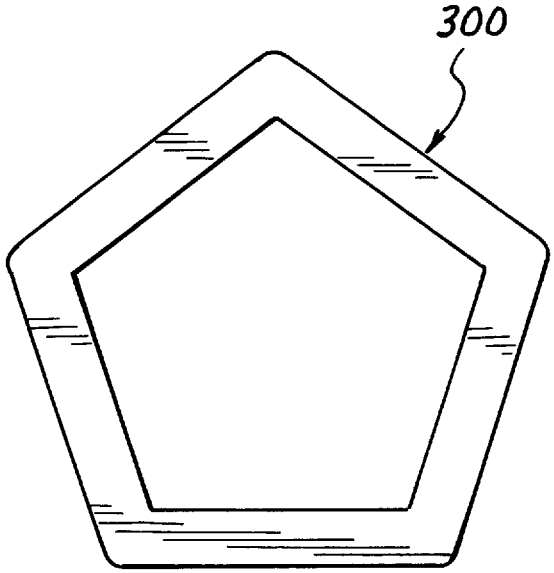
Figure 15:
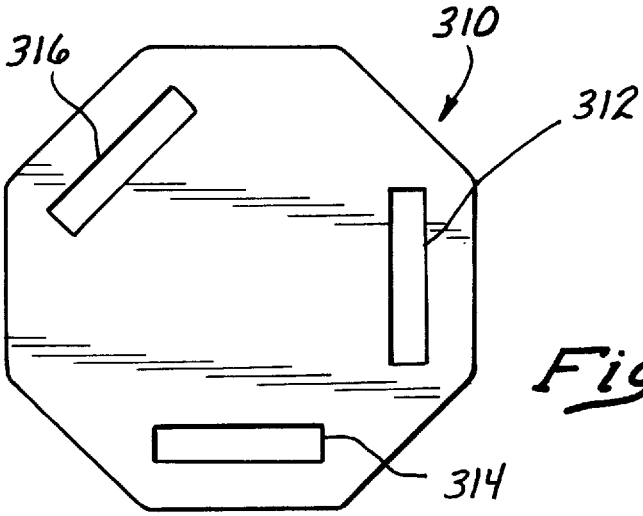

Examples of such other polyangular shapes can be seen in FIGS. 14 and 15. FIG. 14 shows a 5-sided open figure 300. FIG. 15 shows an 8-sided 310 figure which has slots 312, 314 and 316.

The foregoing straps can be configured as a harness portion without the buoyancy compensator or vest or spider portions and secured directly to a backpack.

As can be seen particularly in FIG. 9, the triangular clasp or holder 154 distributes the forces in three directions F, G, and H corresponding to the triangular configuration. Thus, the weight of a cylinder of pressurized breathing gas carried on the diver's backpack 90, the weights in envelopes 140 and 142 carried on the waistbands 126 and 128 and the effects of inflation of the buoyancy compensator 33 are distributed or balanced. This is contrasted with a single strap used in the prior art, and with respect to back loads in general, such as with regard to backpacks.

The swivel buckle 34 pivots to prevent the shoulder or chest portions or straps 30 and 32 or 148 and 150 from pulling up and back. The triangular clasp or holder 154 works to distribute the load independently of the swivel buckle 34. The combination of the swivel buckle 34 and the triangular clasp or holder 154 provides a combination of these advantages. However, the use of one or the other or both depends on location of the weight or loading. The use of the swivel buckle 34 and the triangular clasp or holder 154 together is preferred for a combination buoyancy compensator and support vest, harness or spider and backpack unit which also has weights attached to the waistband. Without the weights, the triangular clasp is still desirable.

Figure 11:
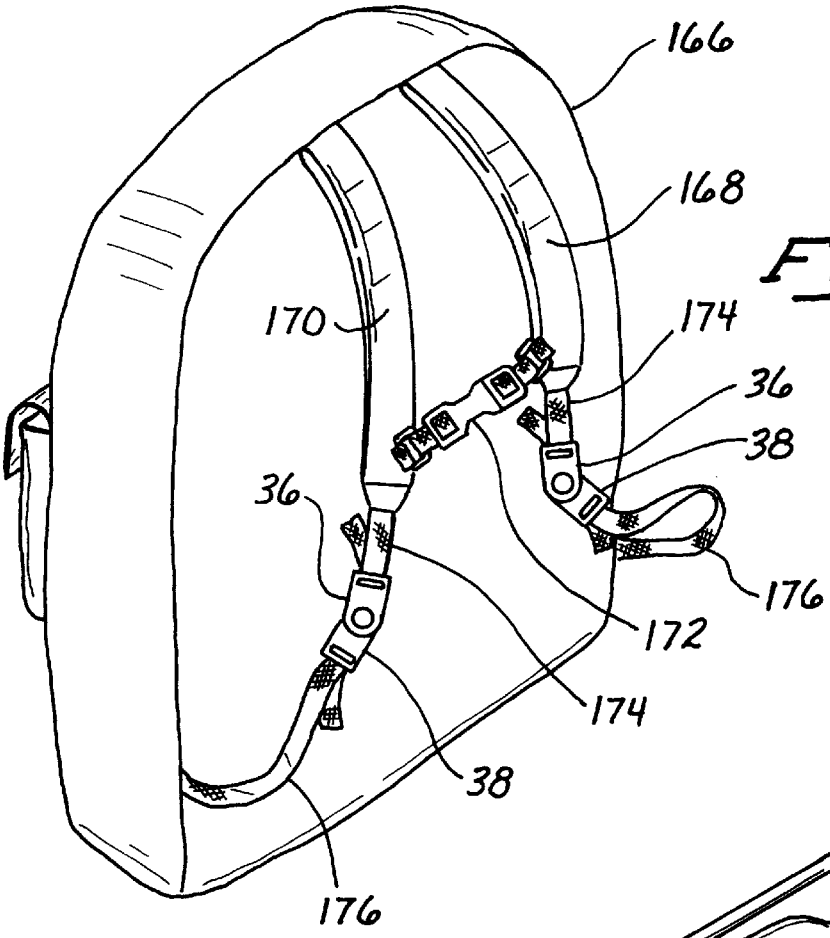
FIG. 11 shows a backpack with the shoulder straps and swivel buckle of the invention.

The swivel or pivot buckle 34 can be advantageously used on a student book or camping backpack 166 as shown in FIG. 11. Here, a pair of padded chest portions 168 and 170 are attached to and extend from the top of the camping or student book backpack 166. A buckle or fastener 172 secured between the padded chest portions 168 and 170 prevents slipping of the padded chest portions.

One portion 36 of the swivel buckle 34 is attached to a strap 174 which is attached to the free end of the padded chest portions 168 and 170. The other portion 38 of the swivel buckle 34 is attached to a strap 176 which is secured to a side of the camping or student backpack 166.

Figure 12:
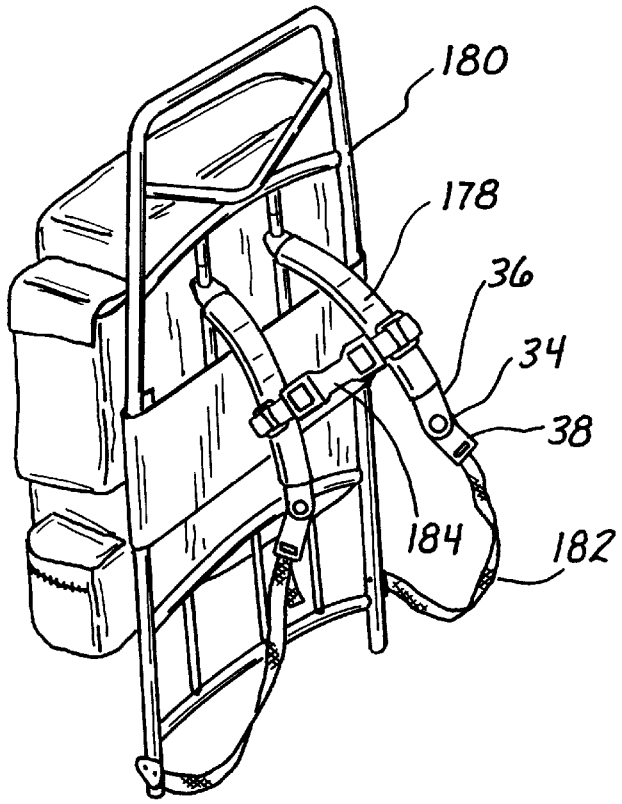
FIG. 12 shows a camping backpack having the shoulder straps and swivel buckle of the invention.

A similar arrangement is shown in FIG. 12 in which shoulder or chest members 178 having one end secured to the upper portion of a back supported frame or harness 180 and the other end attached to one portion 36 of a swivel buckle 34. The other portion 38 of a swivel buckle 34 is attached to strap members 182 which are secured to the lower portion of the harness or framework 180 for supporting a load or weight on the back of a user.

A chest strap buckle or fastener 184 can provide further stability to the shoulder or chest members 178.

The swivel buckle 34 works the same way for the combination buoyancy compensator and support vest, spider or harness and diver's backpack unit of FIGS. 1, 7, 9, and for the student book or camping backpack of FIG. 11 and the framework back carrier or harness backpack of FIG. 12 by pivoting to distribute the load on the chest and back of a user.

Various modifications of the invention are contemplated. Such modifications can incorporate separate or integral vests, backpacks, spiders, harnesses and buoyancy compensators or separate combinations of such supports. For instance, separate straps formed as a harness, and separate modular buoyancy compensators can be used. Also, the buoyancy compensator portions can be on the back, chest or waist or any combination thereof. Such modifications will be obvious to those skilled in the art and can be resorted to without departing from the spirit and scope of the invention as defined in the following claims.

I claim:

1. A support for a diver's backpack comprising:

a back portion;

at least one waistband portion secured to said back portion for fastening around a diver's waist;

first strap members attached to said at least one waistband portion; and, at least one pivoting fastener secured to said first strap members for redistributing the weight of a load between the shoulders, waist and back of a diver.

2. A support according to claim 1 wherein said at least one pivoting fastener comprises:

at least two separable interlocking parts.

3. A support according to claim 2 wherein said at least one pivoting fastener comprises:

a first member having an opening therein;

a second member interlocking with said first member and having a part for receipt and pivotable movement within said opening.

4. A support according to claim 3 wherein:

said opening within said first member is circular;

said part of said second member comprises a circular member; and, a buoyancy compensator secured to said support.

5. A support according to claim 4 wherein:

said circular member of said second member is spring-loaded; and, said buoyancy compensator and support are combined.

6. A support according to claim 5 further comprising:

strap adjustment means attached to at least one member of said at least one pivoting fastener for tightening and loosening said straps against a diver's body.

7. A support according to claim 1 further comprising:

a polyangular holder having at least three sides for securement;

said first strap members being secured to said polyangular holder;

second strap members secured to said polyangular holder and to said at least one waistband portion; and, third strap members secured to said back portion and to said polyangular holder for distribution of the weight of a load between said first, said second, and said third strap members.

8. A support as claimed in claim 7 wherein:

said at least one pivoting fastener is secured to said first strap members between said back portion and said polyangular holder.

9. A support as claimed in claim 1 further comprising:

a gripping surface associated with said at least one pivoting fastener which resists loosening of said first strap members from the weight of a load.

10. A combination buoyancy compensator and support for a diver's backpack comprising:

a back portion;

at least one waistband portion attached to said back portion for securing around a diver's waist;

strap members first adjustable overlying a diver's chest and secured to said at least one waistband portion and connected to said back portion;

a diver's backpack for support of a gas cylinder attached to said back portion;

a buoyancy compensator attached to at least one of said back portion, said backpack, or said at least one waistband portion; and, at least one pivoting fastener secured to said first adjustable strap members whereby said at least one pivoting fastener pivots upon changes in buoyancy or changes in weight being carried for redistributing the weight of a load between shoulders, waist and back of a diver.

11. A combination as claimed in claim 10 further comprising:

weights carried on said combination buoyancy compensator and support for a diver's backpack;

a polyangular holder having at least three sides for securement;

said first adjustable strap members being secured to said polyangular holder;

second strap members secured to said back portion and to said polyangular holder; and, third strap members secured to said at least one waistband portion and to said polyangular holder for redistribution of weight between said first, second, and third strap members.

12. A combination according to claim 11 wherein said at least one pivoting fastener comprises:

a first member having an opening therein;

a second member interlocking with said first member and having a part for receipt and pivotable movement within said opening.

13. A combination as claimed in claim 10 wherein said at least one pivoting fastener comprises:

a first member having an opening therein;

a second member interlocking with said first member and having a part for receipt and pivotable movement within said opening.

14. A combination as claimed in claim 13 wherein:

said opening within said fist member is circular; and, said part of said second member comprises a circular member.

15. A backpack, or a diver's backpack or other back carried framework or support harness having a strap combination comprising:

weight support means for support of a weight on a user's back;

shoulder straps secured generally at the top and bottom of said weight support means which overlie the chest of a user and, at least one pivoting fastener secured to said shoulder straps whereby said at least one pivoting fastener pivots for redistributing the weight of a load between the shoulders, waist and back of a user.

16. A strap combination according to claim 15 wherein said at least one pivoting fastener comprises:

a first member having an opening therein;

a second member interlocking with said first member and having a part for receipt and pivotable movement within said opening.

17. A strap combination according to claim 16 wherein:

said opening within said first member is circular; and, said part of said second member comprises a circular member.

18. A strap combination according to claim 17 further comprising:

at least one gripping surface associated with said at least one pivoting fastener which resists loosening of said straps upon pressure from the weight of a load.

19. A strap combination according to claim 15 further comprising:

at least one waistband for separably fastening together and secured generally to the bottom of the backpack, diver's backpack or other back carried framework or support harness;

at least one polyangular holder having at least three sides for securement;

said shoulder straps being secured to said at least one polyangular holder;

strap members attached to said at least one polyangular holder and to said at least one waistband; and, a rear strap secured to said at least one polyangular holder and to said backpack, diver's backpack, or other back carried framework or support harness for redistributing the weight of a load between the shoulders, waist, and back of a user.

20. A strap combination for a backpack, a diver's backpack or other back carried framework or support harness for support of a weight and having shoulder straps which overlie the chest of a user and at least one waistband for separably fastening around a user's waist comprising:

at least one polyangular holder having at least three sides for securement;

said shoulder straps secured to said at least one polyangular holder;

strap members secured to said at least one polyangular holder and to said waistband; and, rear strap members secured to said at least one polyangular holder and to said backpack, diver's backpack, or other back carried framework or support harness for redistributing the weight of a load between the shoulders, waist and back of a user.

* * * * *